United States Patent [19]

Postol

[11] Patent Number: 4,786,371

[45] Date of Patent: Nov. 22, 1988

[54] BACKBOARD BASKETBALL-RETRIEVER

[75] Inventor: John Postol, Lake Hopatcong, N.J.

[73] Assignee: David Harsanyi, Morris Plains, N.J.; a part interest

[21] Appl. No.: 28,347

[22] Filed: Mar. 20, 1987

[51] Int. Cl.[4] ..... A63B 69/00

[52] U.S. Cl. ..... 273/1.5 A

[58] Field of Search ..... 273/1.5 A, 395–397; D21/201

[56] References Cited

U.S. PATENT DOCUMENTS

| | | | |
|---|---|---|---|
| D. 284,599 | 7/1986 | Cochran | D21/201 |
| 1,765,269 | 6/1930 | Hatley | 273/1.5 A |
| 3,776,550 | 12/1973 | McNabb | 273/1.5 A |
| 3,814,421 | 6/1974 | Spier, Jr. | 273/1.5 A |
| 3,901,506 | 8/1975 | Caveney | 273/1.5 A |
| 3,917,263 | 11/1975 | Wiley | 273/1.5 A |
| 4,291,885 | 9/1981 | Cohen | 273/1.5 A X |

OTHER PUBLICATIONS

Recreation Sports & Leisure 10/1985 Ball-Return Companion.

*Primary Examiner*—Paul E. Shapiro

*Attorney, Agent, or Firm*—William T. Hough

[57] ABSTRACT

In a preferred embodiment, a net-carrying frame pivotally detachably hooked onto a lower portion of a basketball backboard at an upper end of the frame and net, with the lower end of the frame and net being anchored or supported at a lower height forwardly of the backboard in the extended state and positioned to return a basketball bouncing off of the backboard or through the hoop, the frame being supported at its lower end by foldable legs that support the lower end of the net and frame a distance above and spaced from the ground or floor, below the lower level of the backboard. The legs are foldable such that the remaining upper portion of the frame will pivotally swing-back to a storage position directly below the basketball backboard.

25 Claims, 3 Drawing Sheets

FIG. 1
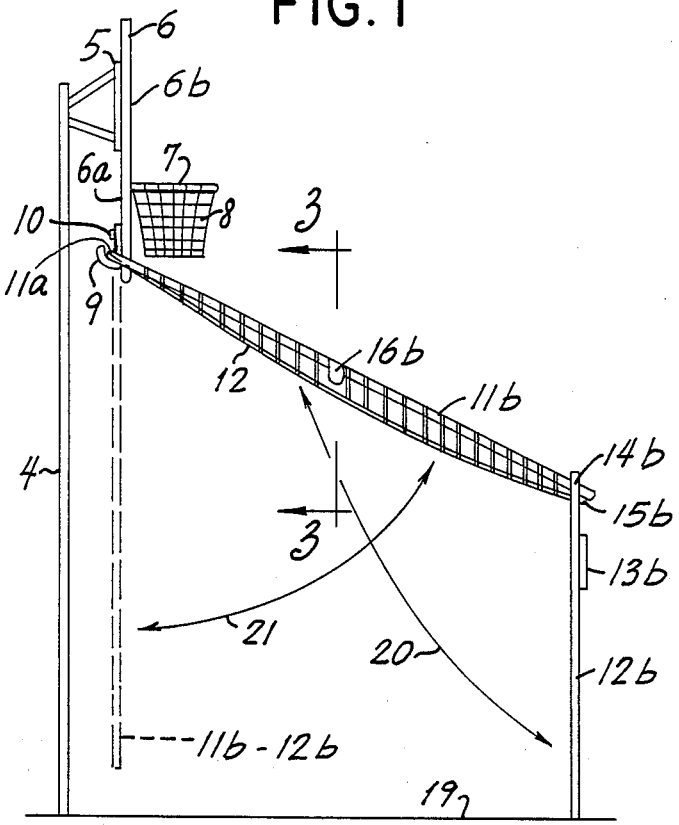
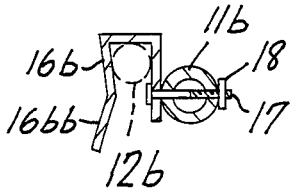
FIG. 3
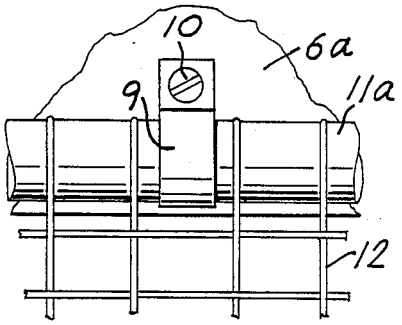
FIG. 4
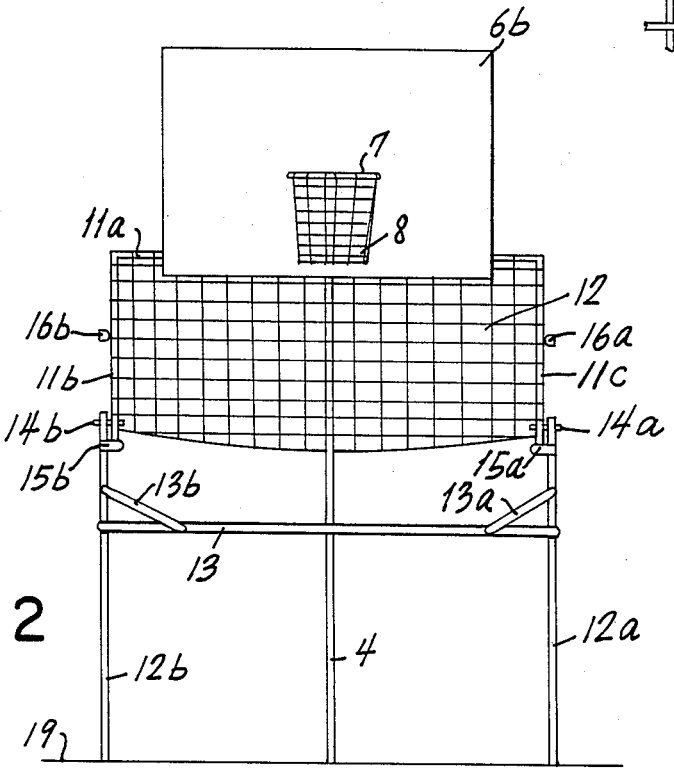
FIG. 2

BACKBOARD BASKETBALL-RETRIEVER

This invention is directed to a basketball return frame and net.

BACKGROUND

Prior to the present invention, there has been a continuing need for a basketball return structure easily mountable on a basketball backboard and adapted to return the ball to a specified particular site and at a level convenient to grasp the returning ball, together with a need that such device not be cumbersome and be easily storable and/or retractable, yet light weight and easy and simple to handle.

Prior to the present invention, there have not been any such structures in existence. Existing typical prior art is evidenced by the following patents, for example. U.S. Pat. No. 1,765,269 to Hatley granted June 17, 1930 discloses a frame of which upper ends are fixedly but detachably inserted into ring-loops extending from a lower edge of a backboard, with the lower end held by insertion into an extended base member lying on the ground; storage is possible solely by withdrawing the inserted upper ends and thereafter during storage folding at hinge-areas located at points positioned about half-way up the frame side-bars. U.S. Pat. No. 3,917,263 to Wiley granted Nov. 4, 1975 is a basket-like apparatus supported from the ground to be positioned beneath a basketball backboard basket such that a ball solely falling through the basket will be guided by railings forwardly to a shooting position. U.S. Pat. No. 3,901,506 to Caveney granted Aug. 26, 1986 discloses a basketball backboard having side-deflectors with a net attached to the side-deflectors and to the backboard, with the bottom of the net fastened forwardly to the floor by unspecified floor inserts. U.S. Pat. No. 4,291,885 to Cohen granted Sept. 29, 1981, somewhat similar to that of Caveney patent, discloses a basketball backboard mounting structure that grasps the entire board and that suspends an upper end of a net from high points along the backboard, as well as from below the board, with the forward end having an attached strap for wrapping around a waist of a person, such as a bed-ridden person, such that the ball is returnable to that person lying in bed. U.S. Pat. No. 3,814,421 to Spier, Jr. granted June 4, 1974 is to a basket attachment, such that when the basketball goes through the basket, it will be caused to fall forwardly toward the center of the basketball court directly in front of the basketball backboard. Accordingly, it can be readily seen that none of these patents approach nor overcome the problems to which the present invention is directed, as follows.

OBJECTS OF THE INVENTION

Thus, objects of the present invention include overcoming the shortcoming of prior art as discussed above.

More particularly, a primary object of the present invention is to obtain an apparatus extendable forwardly during use and retractable or withdrawable during non-use, for during use guiding balls from the basketball backboard and/or basket forwardly to the person shooting.

Another object is obtain an apparatus to guide the ball forwardly from the basketball backboard to a lower end of the net supported at an elevated level facilitating grasping the ball devoid of having to bend-over, as if receiving a pass.

Another object is to obtain an apparatus to support a basketball return-net, providing elongated lateral supports extending downwardly toward a lower end of the net, including structure for collapsing or folding net-supporting structure from a long extended length to a short length adapted for storage suspended beneath a basket backboard.

Another object is to obtain an apparatus that includes a basketball backboard-mountable basketball-retrieval frame and net-mechanism for alternatively pivoting below or detaching from a basketball backboard.

Another objects become apparent from the preceding and following disclosure.

One and/or more of the objects are obtained by the inventive embodiments typically illustrated and described herein.

SUMMARY OF THE INVENTION

Broadly the invention may be described as a basketball backboard ball-return apparatus inclusive of a basket-ball return net mounted on a frame between downwardly-extending laterally spaced-apart elongated supports, and the frame having a pivot mechanism at an upper end thereof attachably mountable on a lower portion of a basketball backboard, and the lower end of the frame having as a part thereof a retention structure and mechanism intermittently retaining the lower end in an outwardly and forwardly pivoted state and position during use. Thereby, when in the forwardly and outwardly pivoted state and position, a ball missing or bouncing off of the backboard or hoop and/or going through the basketball hoop, will fall into the net and be guided toward a lower end of the outwardly and forwardly extended net. After completion of use of the net, the retention mechanism is altered to permit the frame to pivotally swing backwardly and downwardly by virtue of the pivot mechanism, to a storage state and position hanging below the basketball backboard.

In alternate embodiments, the laterally positioned forwardly-extending spaced-apart net-support arms (within the net-mounting portion) of the net-support frame may be foldable or may be telescopable to shorter or lengthened dimensions, and likewise the distal ends thereof may serve as legs, or the lower end (beyond the net-mounting portion thereof) may be pivotable and securable as folding support leg, or such support legs may likewise be telescopable between shortened and lengthened dimensions.

The above-noted pivot mechanism may be any one of a variety of arrangements. For example, the upper portion of the frame net-support may rest on top of support brackets that support the backboard on a mounting post or other mounting structure such as the side of a building or the like; alternatively, there may be upwardly-facing hook or concave structures positioned on the back of the backboard at a lower edge thereof or upper edge thereof or at any intermediate location, such that the upper cross-bar of the frame net-support rests on the upwardly-facing concave face of the hook or concave structure. In a different embodiment, hanging-brackets may be fastened to the cross-bar of the frame net-support such that the cross-bar may be suspended onto the top edge of the backboard, by typically spaced-apart brackets.

In one preferred embodiment, there is elongated supports-extension structure and mechanism of the elongated supports, permitting the elongated supports to be extended to a state and position at which effective combined forward and downward distances are greater in the extended state than downward distance from the basketball backboard's lower portion downwardly to the floor or ground level, but in the non-extended state and position extended a distance no greater than that downward distance to the floor or ground level. Accordingly, while in the extended state, the net is supported at a combined forward and downward distance from the lower portion of the basketball backboard, in the retracted state of the shortened distance it has become possible to store the ball-return apparatus in its downwardly pivoted state and position hanging directly beneath the basketball backboard, beneath that lower portion of the backboard.

In another more preferred embodiment, the elongated supports-extension structure of each elongated support comprises proximal and distal portions of the elongated supports and an intermediately-positioned hinge structure and mechanism providing for interconnecting the distal end of the proximal portion to the proximal end of the distal portion, adapted for alternately folding the distal portion to and from the extended state, relative to the retracted state suitable for pivoting rearwardly in a thereby shortened state to the storage position pivotally hanging beneath the basketball backboard.

In a more preferred embodiment, the hinge structure and mechanism includes a locking structure and mechanism adapted to intermittently lock the distal portions in the open hinged extended-state position and to unlock it for folding to the retraction state and position, and adapted to retain in the locked state the distal portions in positions such that the distal portions serve and function as support legs. In the locked state, the supporting legs support upwardly the distal ends of the proximal portions at an elevation spaced-above ground or floor level, preferably at a level typically of chest level of a typical basketball-shooter.

In another preferred embodiment, the proximal, i.e. upper, end of the proximal (upper) portion of the frame structure is intermittently attachable to and detachable from the basketball backboard by virtue of the pivot structure and mechanism additionally including detachable structure and mechanism therefor. Accordingly, when for more permanent long-term storage of the basketball-return apparatus, the upper end of the frame is simple detachable and the apparatus storage in a garage or attic in the folded state above-described.

While the above-described basketball-return apparatus is utilizable with any already existing basketball backboard by merely mounting the pivot structure (and mechanism-works thereof) onto a basketball backboard, typically and preferably at and on a lower portion thereof, another embodiment of the invention includes as a part of the overall combination also a basketball backboard on which preferably the pivot structure (and mechanism-works thereof) are already mounted or adapted to be mounted. This embodiment would be practically sold with new basketball backboards.

In another embodiment of the invention, there is provided a basketball-return net and frame structure with the frame laterally spaced-apart elongated supports, taken together with an attachment structure and mechanism therefor for mounting an upper end of the frame onto a lower portion of a basketball backboard, with the improvement lying in combination therewith, the above-described foldable and lockable legs which in the locked extended-state and position support the upper or proximal portion of the frame in a position with the distal end of the proximal portion supported in an elevated position and state spaced away from and above the ground or floor level.

Optionally, instead of a hinge structure, there may be provided a telescoping arrangement as a mechanism for bringing the legs to a retracted storage position and state, as earlier described; likewise, there may also be telescoping cross-bars that would be particularly advantageous in reducing storage space required.

The invention may be better understood by making reference to the following figures illustrative of preferred embodiments of this invention.

THE FIGURES

FIG. 1 illustrates diagrammatically a side view of a preferred embodiment of the invention, also showing the folded position and state.

FIG. 1A illustrates diagrammatically in an in-part view, an alternate embodiment of the structure of FIG. 1, as shown in side view, the same except as otherwise shown in in-part side view of the forwardly-extended frame net-support structure, with the distal ends of the spaced-apart lateral net-supports having the angular distal ends functioning as legs that telescope into or around the upper (proximal) portions of the frame net-support lateral structures.

FIG. 1B diagrammatically illustrates a different other embodiment in likewise an in-part view, the same as FIG. 1 except as otherwise shown, in which the downwardly-extended legs (in locked-state and position, intermittently unlockable to permit folding), is telescopable; likewise, the proximal portions of the frame net supports are also telescopable as shown in side view.

FIG. 2 illustrates a front diagrammatic view of the same embodiment as that of FIG. 1.

FIG. 3 illustrates diagrammatically a cross-sectional view of a latching device adapted for holding the folded legs in the upwardly folded state and position, showing in phantom the location of a leg when secured thereby.

FIG. 4 illustrates diagrammatically an in-part view of a back face of the backboard having the mounting pivot structure with the upper end of the net-mounted frame mounted therein.

Figure 5:
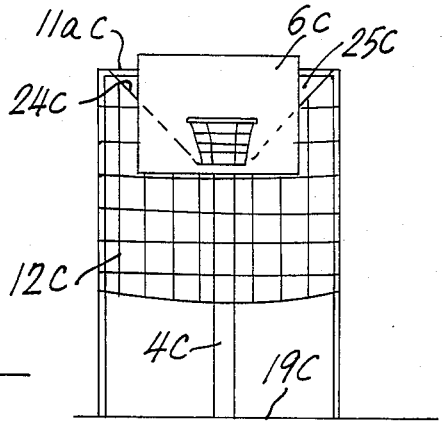

FIG. 5 diagrammatically illustrates a still other alternate embodiment, basically similar and identical to that of FIG. 1, except that the pivot structure is positioned at an upper portion of the back of the backboard, having the upper central portion of the net not attached to the cross-bar of the frame net support, such that the upper end of the net is stretchable to points below brackets mounting the backboard, shown if a forward view.

Figure 5A:
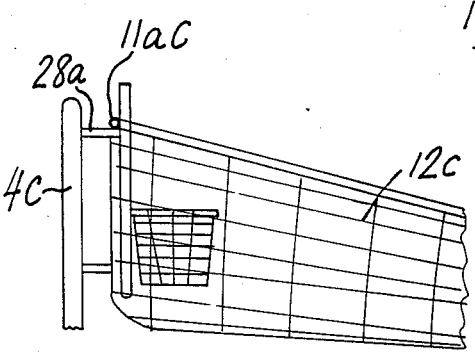

FIG. 5A diagrammatically illustrates in an in-part view, a side view of the embodiment of FIG. 5.

Figure 5B:
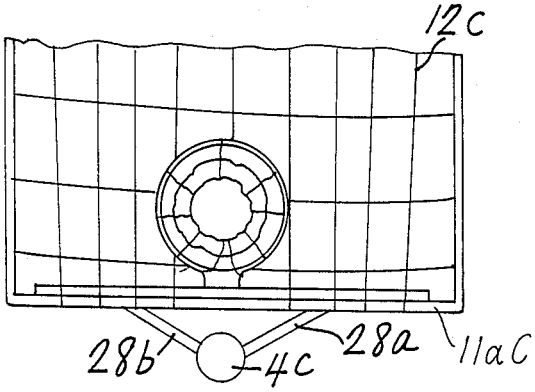

FIG. 5B diagrammatically illustrates in an in-part view, a top view of the embodiments of FIGS. 5 and 5A.

Figure 6:
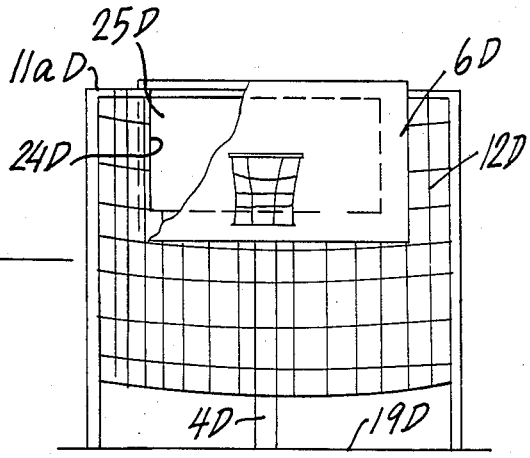

FIG. 6 illustrates diagrammatically in a front view, a still other embodiment of FIGS. a and 5, with partial cut-away view illustrating the squared upper-design of the net, allowing it to circumscribe back-board mounting bracket when the crossbar of the frame net-support is supported on the pivot structure positioned and mounted high on an upper portion of the backboard. This embodiment is otherwise identical to that of FIG. 5.

Figure 7:
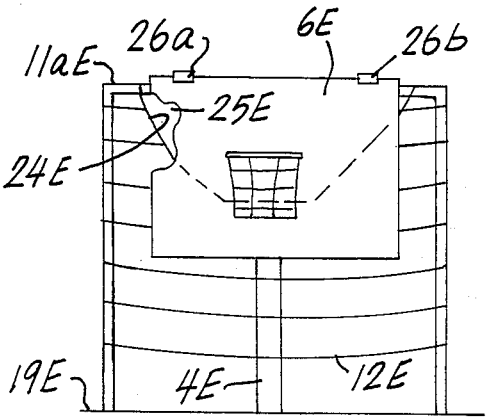

FIG. 7 diagrammatically illustrates another alternate embodiment similar and identical to FIGS. 1, 5 and 6, except as otherwise shown, having spaced-apart brackets attached to the upper crossbar of the frame net-support structure, each bracket being provided with an upper cup or hook-shape adapted to and shown hanging over the top edge of the backboard, thereby supporting the upper end of the net frame support or upper crossbar of the frame net support structure, with the net having a cutout or shape angling downwardly from a central portion of the crossbar such that it circumscribes (beneath) the supports normally present for mounting the backboard on a post or wall or the like, shown also in forward or front view.

Figure 7A:
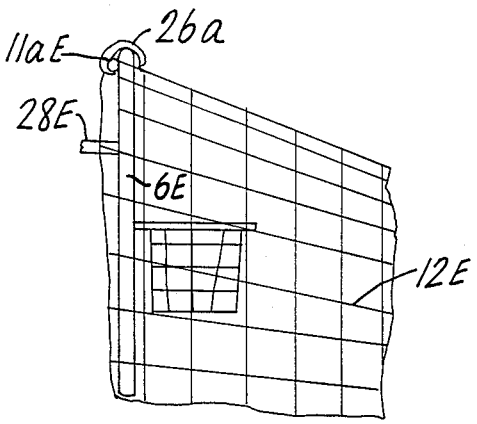

FIG. 7A illustrates an in-part side view of the embodiment of FIG. 7.

Figure 7B:
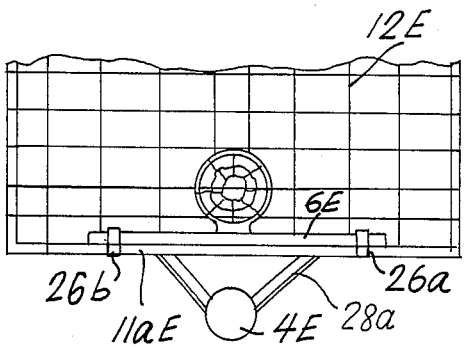

FIG. 7B illustrates an in-part top view of the embodiments of FIGS. 7 and 7A.

Figure 8:
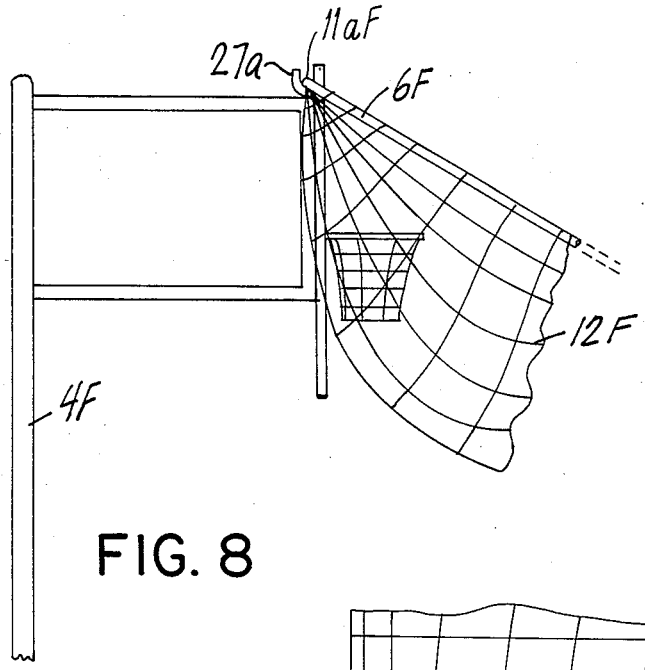

FIG. 8 illustrates a still other alternate embodiment similar and identical to the embodiment of FIG. 1 except as otherwise shown, in an in-part view, the pivot hooks being positioned at or near an upper edge of the back face of the backboard, this view being a sideview in in-part view.

Figure 8A:
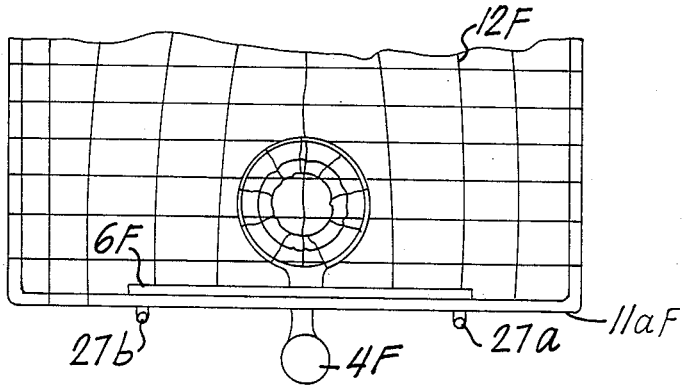

FIG. 8A illustrates an in-part top view of the embodiment of FIGS. 8 and 8A.

DETAILED DESCRIPTION

For the different views of the same embodiment of FIGS. 1 through 4, identical indicia are utilized. For the same embodiment, the same type element at different locations is identified by a similar but different indicia, to facilitate understanding and following of the description.

All of FIGS. 1 through 4 disclose a common embodiment. Figure 1 shows the support pole 4 and its supporting frame 5 supporting the basketball backboard 6 as a part of the general basketball backboard structure, with the backboard rearward (back) face 6*a* and its forward (front) face 6*b*. The basketball hoop 7 is mounted conventionally on the front face 6*a*. The basketball hoop 7 is mounted conventionally on the front face 6*a*, with the net 8 thereof. Mounted onto the lower portion of the back face by typically large screw or bolt 10 is the hook-shaped pivot structure 9 having resting therein the upper horizontal frame bar (crossbar) 11*a* from which the downwardly and forwardly extending spaced-apart elongated supports (proximal portions of the frame net support structure)—bars 11*b* and 11*c*, extend, the net 12 being suspended between the bars 11*b* (see FIG. 2) and 11C, as well as preferably also mounted (as shown diagrammatically in FIG. 4) on the upper crossbar 11*a*. Lower distal ends of outwardly-positioned frame-bars 11*b* and 11*c* are supported in a spaced-away relationship from the ground or floor level (diagramatically shown as substrate 19) by the distal portions (legs) 12*b* of the frame's spaced-apart elongated supports, having its own further bracing-structures 13*a* (see FIG. 2) and 13*b* bracing cross-brace 13, and having hinge pins 14*a* (see FIG. 2) and 14*b*, and having abutments 14*a* (see FIG. 2) and 14*b* which prevent the legs 12*a* and 12*b* from swinging further-out, thus avoiding accidental collapse, noting that the legs 12*a* and 12*b* may optionally be positioned with their distal (ground level) ends slightly further-out from the backboard to avoid possibility of being accidentally kicked inwardly in a folding-up direction. When ready to store intermittently, the legs 12*a* and 12*b* are folded along arc 20 to snap into the retainer structures 16*a* and 16*b*, having guide lips such as guide lip 16*bb* of FIG. 3. The retainer structures 16*a* and 16*b* are mounted by any desired or conventional means, such as illustrated in FIG. 3 by a threaded bolt 17 and nut 18, with the bolt extending through holes in the legs such as the leg 11*b* as shown in FIG. 3, illustrating in phantom the distal elongated support (leg) 12*b* as secured therein for storage. After folding-up the legs 12*a* and 12*b* into the storage position shown in FIG. 3, the frames upper bars 11*a* and 11*b* are pivoted rearwardly along arc 21 to be suspended in the phantom-position 11*b*–12*b* (FIG. 2). By reverse pivotal movement along arc 21, and thereafter unfolding legs 12*a* and 12*b* along arc 20, the frame and net thereon become again erected to the FIG. 2 position and state, ready for the shooting of basketballs which will be returned to the bottom of the net by rolling forwardly.

Figure 1A:
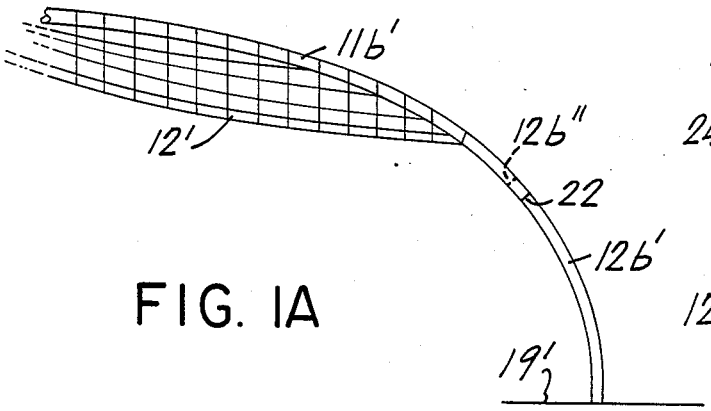
Figure 1B:
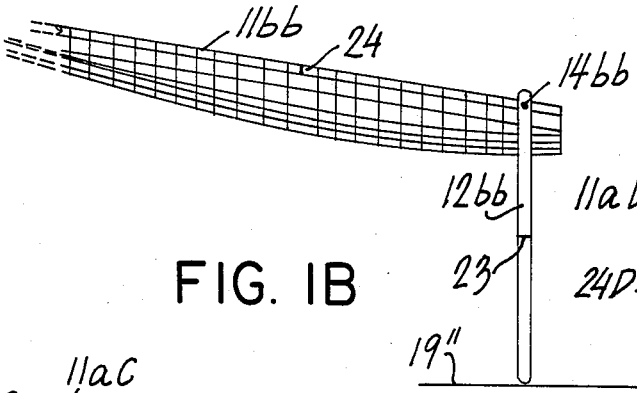

FIG. 1A diagrammatically illustrates in side view, the proximal frame net angular lateral-support portion 11*b*′ and the distal frame net angular lateral-support portion 12*b*′, one telescoping into the other at telescoping point 22, in this case the distal portion 12*b*′ telescoping into the proximal portion 11*b*′, shown in phantom at 12*b*″ (within portion 11*b*′). The lower end of the distal portion 12*b*′ is resting on the ground or floor 19′. FIG. 1B illustrates the proximal portion 11*bb* being composited of two separate telescoped portions telescoped at point 24, and the leg (distal portion) 12*bb* being pivoted on pin 14*bb* and telescoping at point 23, one portion thereof into the other. Likewise, the lower end of the leg 12*bb* rests on the ground or floor 19″.

FIG. 5, 6, 7 and 8 illustrates variations on the embodiment of FIG. 1, each otherwise identical basically, to the embodiment of FIG. 1. FIG. 5 has upper net-supporting crossbar 11*ac* having the upper end of the net centrally detached such that it is stretched below typical rearwardly-located backboard bracket-supports of post 4*c*, while the cross-bar is mounted at an elevated position on the backside of the backboard 6*c* by the pivot mechanism of this invention. The upper edge 24*c* of the net 12*c* is shown angled downwardly in its stretched position and shape, with space 25*c* being thereby provided. FIG. 5A better illustrates the crossbar 11*ac* resting on the upper backboard bracket 28*a* of the post 4*c*. FIG. 5B illustrates the crossbar 11*ac* resting on top of both brackets 28*a* and 28*b* of post 4*c*.

FIG. 6 differs only slightly from the embodiment of FIG. 5, in that the net has a squared cut-out design beneath a central portion of the top crossbar 11*ad*, thereby providing space 25D such that the upper central portion of the net 12D extends beneath any backboard support brackets of the types shown in FIGS. 5A and 5B.

FIG. 7 illustrates a different variation on the pivot device, differing from the embodiment of FIG. 6 in the shape of the cut-out design at the central upper net portion below the upper crossbar 11*a*E, being angled downwardly toward the center, to thereby circumscribe any typical backboard support brackets such as shown in FIG. 5A and 5B. Additionally, however, this embodiment has the upperwardly positioned pivot mechanism and structures 26*a* and 26*b* thereof, in the form of spaced-apart hook-shaped structures 26*a* and 26*b*, each mounted on the upper frame crossbar 11*a*E, positioned to hook-over the top-edge of the backboard. Accordingly, the upper end of the frame net-support structure is suspended on the top edge of the backboard, being intermittently detachable.

FIG. 7A better illustrates in side view the bracket 26*a* supporting the crossbar 11*a*E on the top edge of the backboard 6E.

FIG. 7B illustrates a top view of both pivot-brackets (pivot structures), 26*a* and 26*b*), hooked over the top edge of the backboard 6E.

FIG. 8 illustrate in side view a pivot hook-device 27*a* similar to that of FIG. 1, except here mounted at an upper edge of the back face of the backboard, with the crossbar 6F of the upper end of the frame net-support structure being thereby supported on the backboard that is mounted by a bracket onto post 4F.

FIG. 8A illustrates a top view of the crossbar 6F resting on top of the pivot structures 27*a* and 27*b*.

The frame of this invention is typically of any conventional metal, preferably of a light-weight metal such as aluminum, but may be plastic in whole or in part, and likewise for various ones of the above-described elements elements such as the pivot structure which preferably would be of steel so as to withstand major strains and weights. Apart from being preferably light-weigh but sturdy, the invention is not in the material of the frame nor in the composition of the net, any conventional or desired net being suitable, in accord with existing net-art of a conventional nature.

It is within the scope and contemplation of this invention to include variations and modifications and substitution of equivalents as would be apparent and obvious to a person of ordinary skill in this art.

I claim:

1. A basketball backboard ball-return device comprising in combination:a basketball-return net; a frame means for suspending said net, said frame means having upper and lower ends and including downwardly-extending laterally spaced-apart elongated supports, said net being mounted on and between each of said spaced-apart elongated supports; pivot means for pivotably attaching said upper end of said frame means to a lower portion of a basketball backboard, said pivot means being attachable to said upper end of said frame means such that when the frame means is attached to said lower portion, said lower end of said frame means is pivotable forwardly outwardly from beneath the basketball backboard on which the upper end is mounted; and retention means for intermittently anchoring said lower end forwardly of said basketball backboard such that when anchored forwardly a basketball bouncing off of said backboard is downwardly and forwardly guidable by said net to said lower end.

2. A basketball backboard ball-return device of claim 1, in which said elongated supports extend a predetermined length adapted to be greater than a downward-distance from a lower portion of said basketball backboard to ground or floor level, and said elongated supports including extension means, for adjusting the elongated supports to extend downwardly a distance no greater than said downward-distance when suspended directly downwardly below the lower portion of the basketball backboard, whereby said frame means and said net are storable in a directly downwardly-positioned rearwardly-retracted state beneath said lower portion.

3. A basketball backboard ball-return device of claim 2, in which each of said elongated supports includes spaced-apart proximal and distal portions each having proximal and distal ends, and said extension means comprises a separate hinge means for each said elongated supports, for interconnecting said distal end of said proximal portion to said proximal end of the said distal portion such that said distal portion is foldable to a position permitting the lower end of said frame means to be rearwardly retracted to a storage position directly beneath the basketball backboard.

4. A basketball backboard ball-return device of claim 3, in which said hinge means includes locking means for intermittently locking said distal portions in substantially downwardly-extending upright positions relative to ground or floor level and extending angularly relative to said proximal portions when said lower end is pivoted forwardly outwardly, such that said distal ends of said proximal portions are upwardly supported and spaced-above ground or floor level a distance substantially equal to lengths of said distal portions, by said distal portions serving as legs when said lower end is pivoted forwardly outwardly.

5. A basketball backboard ball-return device of claim 4, in which said pivot means includes detachable structure such that said frame means is intermittently detachable from said lower portion of said backboard.

6. A basketball backboard ball-return device of claim 5, including said backboard.

7. A basketball backboard ball-return device of claim 4, including said backboard.

8. A basketball backboard ball-return device of claim 3, including said backboard.

9. A basketball backboard ball-return device of claim 3, in which said pivot means includes detachable structure arranged such that said frame means is intermittently detachable from said lower portion of said backboard.

10. A basketball backboard ball-return device of claim 2, including said backboard.

11. A basketball backboard ball-return device of claim 2, in which said pivot means includes detachable structure arranged such that said frame means is intermittently detachable from said pivot means when the pivot means is mounted on a backboard.

12. A basketball backboard ball-return device of claim 2, in which said frame means includes a horizontal crossbar positioned at and supporting said proximal end of said net,.

13. A basketball backboard ball-return device of claim 1, including said backboard.

14. A basketball backboard ball-return device of claim 1, in which said pivot means includes detachable structure arranged such that said frame means is intermittently detachable from said lower portion of said backboard.

15. A basketball backboard ball-return device of claim 14, including said backboard.

16. A basketball backboard ball-return device of claim 1, in which at-least one of said upper and lower end includes proximal and distal portions of which one telescopes retractably into the other.

17. A basketball backboard ball-return device of claim 16, in which said downwardly-extending support structure includes said lower end, and in which said lower end includes proximal and distal portions of which one telescopes retractably into the other.

18. A basketball backboard ball-return device of claim 1, in which one of said upper and lower ends telescopes retractably into the other of said upper and lower ends.

19. A basket backboard ball-return device of claim, 1, in which a lower portion of said downwardly-extending spaced-apart elongated supports is angular in shape.

20. A basketball backboard ball-return device comprising in combination: a basketball-return net; a frame means for suspending said net, said frame means having upper and lower ends and including downwardly-extending laterally spaced-apart elongated supports, said net being mounted on and between each of said spaced-apart elongated supports, said elongated supports extending a predetermined length adapted to be greater than a downward-distance from a lower portion of said basketball backboard to ground or floor level; retention means for intermittently anchoring said lower end forwardly of said basketball backboard such that when anchored forwardly a basketball bouncing off of said backboard is downwardly and forwardly guidable by said net to said lower end; and extension means mounted on said elongated supports such that when suspended directly downwardly below the lower portion of the basketball backboard the elongated supports are adjustable to extend downwardly a distance no greater than said downward-distance, whereby said frame means and said net are storable in a directly downwardly-positioned rearwardly-retracted state beneath said lower portion.

21. A basketball backboard ball-return device of claim 20, in which, each of said elongated supports includes space-apart proximal and distal portions each having proximal and distal ends, and said extension means comprising a separate hinge means for each said elongated supports, for interconnecting said distal end of said proximal portion to said proximal end of said distal portion such that said distal portion is foldable to a position permitting the lower end of said frame means to be rearwardly retracted to a storage position directly beneath the basket ball backboard.

22. A basketball backboard ball-return device of claim 21, in which said hinge means includes locking means for intermittently locking said distal portions in substantially downwardly-extending upright positions relative to ground or floor level and extending angularly relative to said proximal portions when said lower end is pivoted forwardly outwardly supported and spaced-above ground or floor level a distance substantially equal to lengths of said distal portions, by said distal portions serving as legs when said lower end is pivoted forwardly outwardly.

23. A basketball backboard ball-return device of claim 20, in which said elongated supports are positioned as legs supporting a lower end of said basketball-return net a predetermined distance spaced-above ground or floor level sufficiently high to facilitate grasping a returned-ball without bending-over.

24. A basketball backboard ball-return device comprising in combination: a basketball-return net having proximal and distal ends; a frame means for suspending said net, said frame means having upper and lower ends and including downwardly-extending support structure, said net being mounted on said frame means such that a basketball bouncing off of a backboard is downwardly and forwardly guidable by said net to said lower end; basketball-backboard net-support means for detachably mounting onto a basketball backboard and for supporting thereon said upper end such that said frame means is downwardly suspendable from a basketball backboard and is intermittently detachable therefrom, and for downwardly suspending said upper end therefrom, said basketball-backboard net support means including a member extendable from a rearward face of a basketball-backboard and a horizontal crossbar at said upper end of said frame means positioned at and supporting said proximal end of said net, said crossbar being adapted for resting on said member with the remainder of said frame means and said net suspending downwardly therefrom.

25. A basketball backboard ball-return device comprising in combination: a basketball-return net having proximal and distal ends; a frame means for suspending said net, said frame means having upper and lower ends and including downwardly-extending support structure, said net being mounted on said said frame means such that a basketball bouncing off of a backboard is downwardly and forwardly guidable by said net to said lower end; basketball-backboard net-support means for detachably mounting onto a basketball backboard and for supporting thereon said upper end such that said frame means is downwardly suspendable from a basketball backboard and is intermittently detachable therefrom, and for downwardly suspending said upper end therefrom, said basketball-backboard net support means including a horizontal crossbar at said upper end of said frame means positioned at and supporting said proximal end of said net, and mounting means for suspending said horizontal crossbar on said basketball backboard, said mounting means including at-least one hook attached to said crossbar shaped and adapted to be mounted onto the upper edge of a basketball backboard such that said horizontal crossbar is supportable by said hook when said hook is mounted on a basketball backboard.

* * * * *